US007648385B2

(12) United States Patent
Wu

(10) Patent No.: US 7,648,385 B2
(45) Date of Patent: Jan. 19, 2010

(54) ELECTRICAL CONNECTOR HAVING A LED DEVICE THEREON

(75) Inventor: Jian-Feng Wu, Kunshan (CN)

(73) Assignee: Hon Hai Precision Ind. Co., Ltd, Taipei Hsien (TW)

( * ) Notice: Subject to any disclaimer, the term of this patent is extended or adjusted under 35 U.S.C. 154(b) by 0 days.

(21) Appl. No.: 12/380,079

(22) Filed: Feb. 23, 2009

(65) Prior Publication Data

US 2009/0215308 A1 Aug. 27, 2009

(30) Foreign Application Priority Data

Feb. 22, 2008 (CN) ..... 2008 20 032297

(51) Int. Cl.
*H01R 3/00* (2006.01)

(52) U.S. Cl. ..... 439/490

(58) Field of Classification Search ..... 439/490, 439/607, 676, 609; 362/95
See application file for complete search history.

(56) References Cited

U.S. PATENT DOCUMENTS 5,685,737 A 11/1997 Morin et al.
6,142,822 A * 11/2000 Wu ..... 439/490
6,319,062 B1 * 11/2001 Ma et al. ..... 439/607.38
6,457,993 B1 10/2002 Espenshade
6,464,533 B1 10/2002 Ma et al.
6,638,121 B1 10/2003 Walker et al.
6,688,908 B2 * 2/2004 Wallace ..... 439/490
6,688,909 B1 * 2/2004 Espenshade et al. ..... 439/490
7,458,843 B2 * 12/2008 Xie ..... 439/490

* cited by examiner

*Primary Examiner*—Neil Abrams
*Assistant Examiner*—Phuong Nguyen
(74) *Attorney, Agent, or Firm*—Andrew C. Cheng; Wei Te Chung; Ming Chieh Chang

(57) ABSTRACT

An electrical connector includes a display device (3) having an illuminant portion (31) and legs (32) extending from the illuminant portion. An insulating housing (1) has a front wall (111), a rear wall (112), four side walls (113) and a receiving cavity (13) recessed from one side wall (113A) and running though the front wall (111) so as to form a retaining portion (141) and at least one first blocking portion (142) at a front section thereof. A plurality of terminals (2) are mounted in the insulating housing thereof. The retaining portion (141) is located at an outer side of the receiving cavity (13) and over the illuminant portion (31) to prevent the illuminant portion from outward moving, and the first blocking portion (142) is located in front of the illuminant portion (31) and abuts against the illuminant portion to prevent the illuminant portion from forward moving.

14 Claims, 7 Drawing Sheets

ELECTRICAL CONNECTOR HAVING A LED DEVICE THEREON

BACKGROUND OF THE INVENTION

1. Field of the Invention

The present invention relates to an electrical connector, and particularly to an electrical connector having a LED device thereon.

2. Description of the Related Art

U.S. Pat. No. 6,638,121 discloses an electrical connector having a LED device thereon. The electrical connector has an insulating housing defining a top face and a front face. A receiving cavity recesses downward from the top face and runs through the front face for receiving the LED device. A stopping portion is defined at one side of a front portion of the receiving cavity, and two elongated slots extend rearward in the insulating housing and communicate with the receiving cavity. The LED device includes a large illuminant portion and a pair of legs. The illuminant portion has a smaller front end so that a pair of stopping faces facing forward are respectively formed at opposite sides. The legs are rearwards inserted into the slots and then the illuminant portion is pressed into the receiving cavity, during which the stopping faces are against the stopping portion. However, the assembling process is not facility for mass production. Hence, an electrical connector is needed to solve the problem.

SUMMARY OF THE INVENTION

Accordingly, an object of the present invention is to provide an electrical connector with a LED device easily mounted thereon.

In order to achieve the object set forth, an electrical connector comprises a display device, having an illuminant portion and legs extending from the illuminant portion, an insulating housing having a front wall, a rear wall, four side walls, and a receiving cavity recessed from one side wall and running though the front wall so as to form a retaining portion and at least one first blocking portion at a front section thereof, and a plurality of terminals mounted in the insulating housing thereof. The retaining portion is located at an outer side of the receiving cavity and over the illuminant portion to prevent the illuminant portion from outward moving, and the first blocking portion is located in front of the illuminant portion and abuts against the illuminant portion to prevent the illuminant portion from forward moving.

Other objects, advantages and novel features of the invention will become more apparent from the following detailed description of the present embodiment when taken in conjunction with the accompanying drawings.

DETAILED DESCRIPTION OF THE INVENTION

Figure 1:
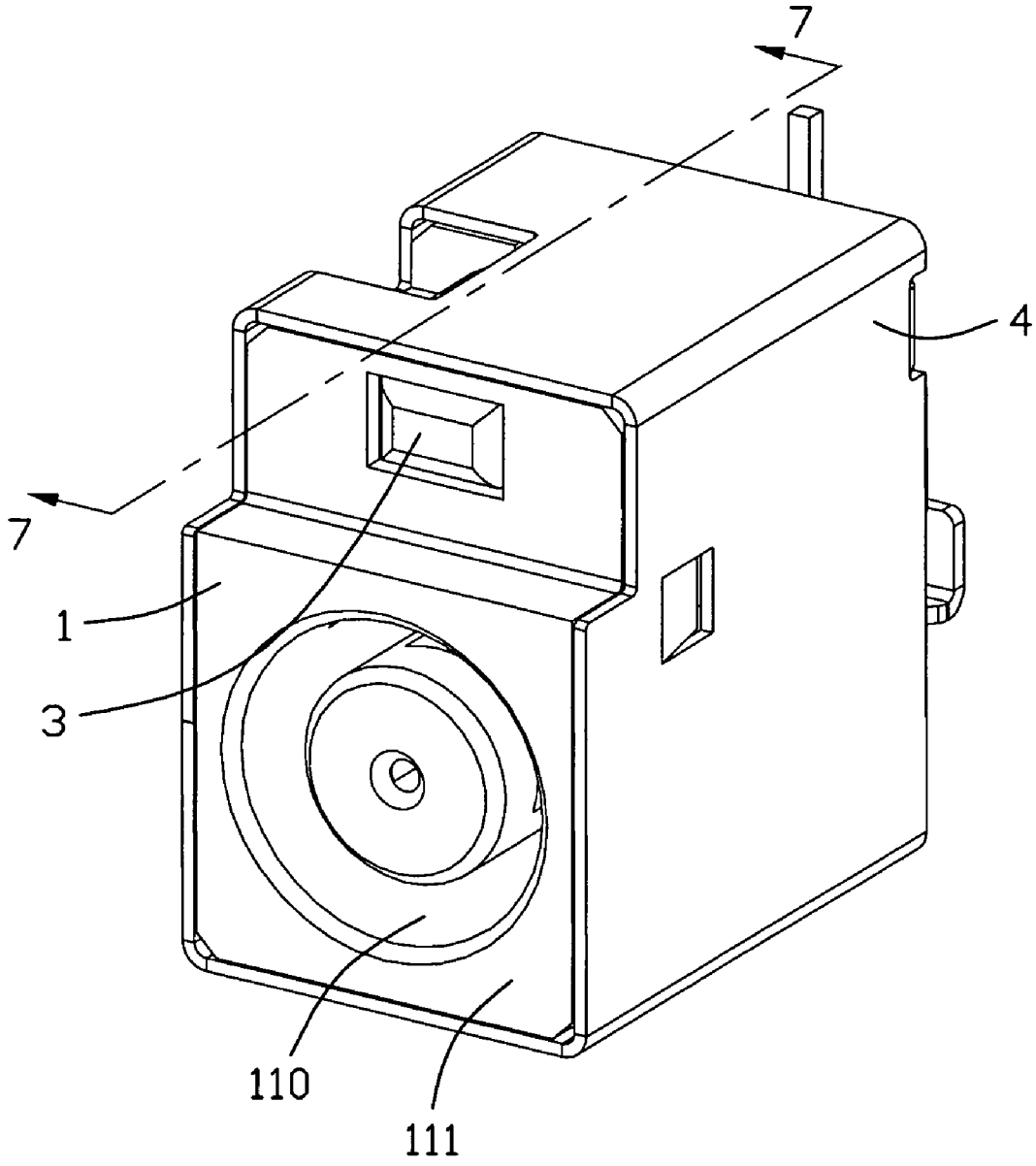
FIG. 1 is a front perspective view of an electrical connector in accordance with the present invention.
Figure 2:
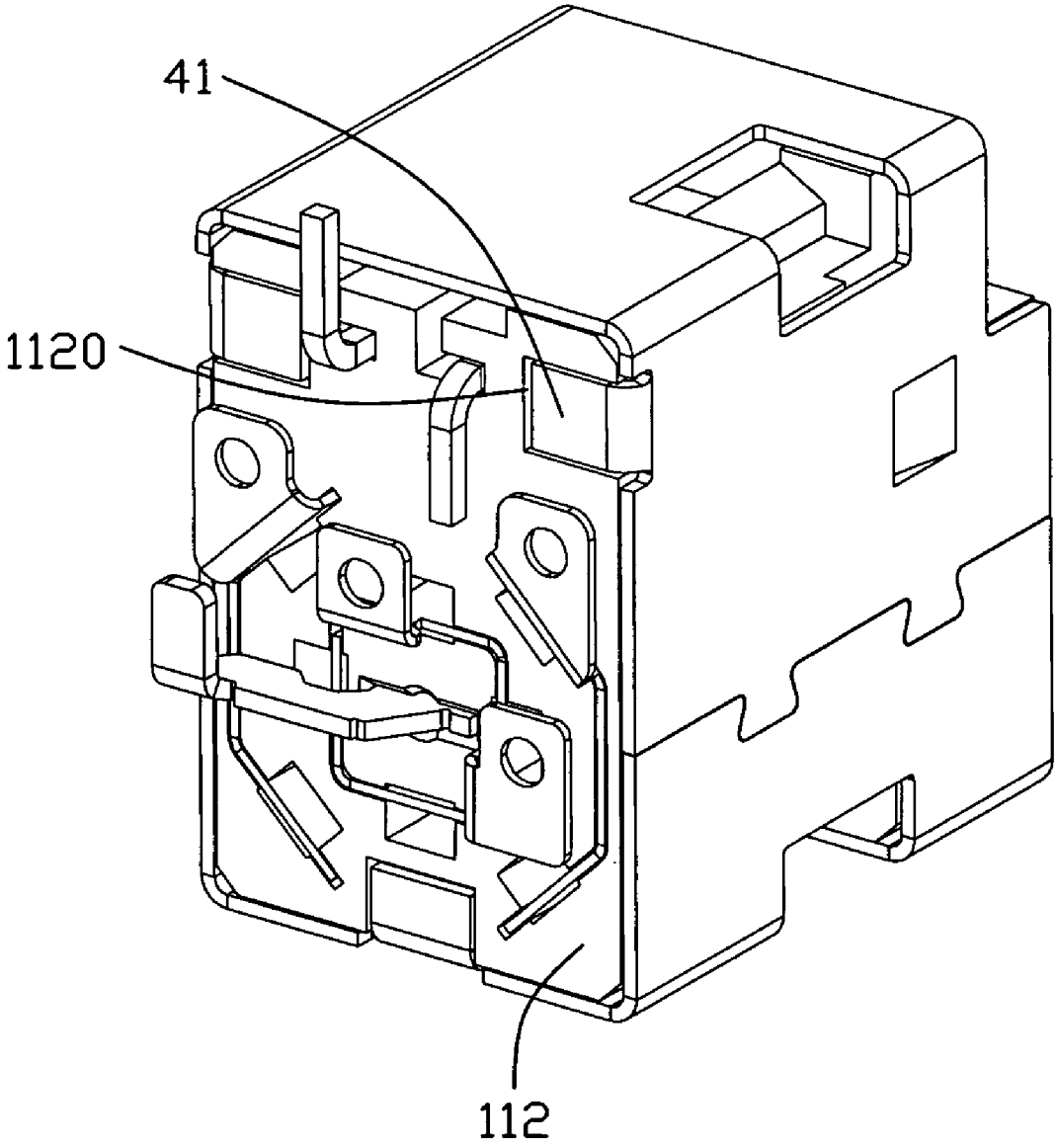
FIG. 2 is a rear perspective view of the electrical connector shown in FIG. 1.

Reference will now be made to the drawing figures to describe a preferred embodiment of the present invention in detail. Referring to FIGS. 1 and 2, an electrical connector according to the preferred embodiment of the present invention is provided and comprises an insulating housing 1, a plurality of terminals received in the insulating housing, a LED device 3 mounted on the insulating housing and a metallic shell 4 covering on the insulating housing.

Figure 3:
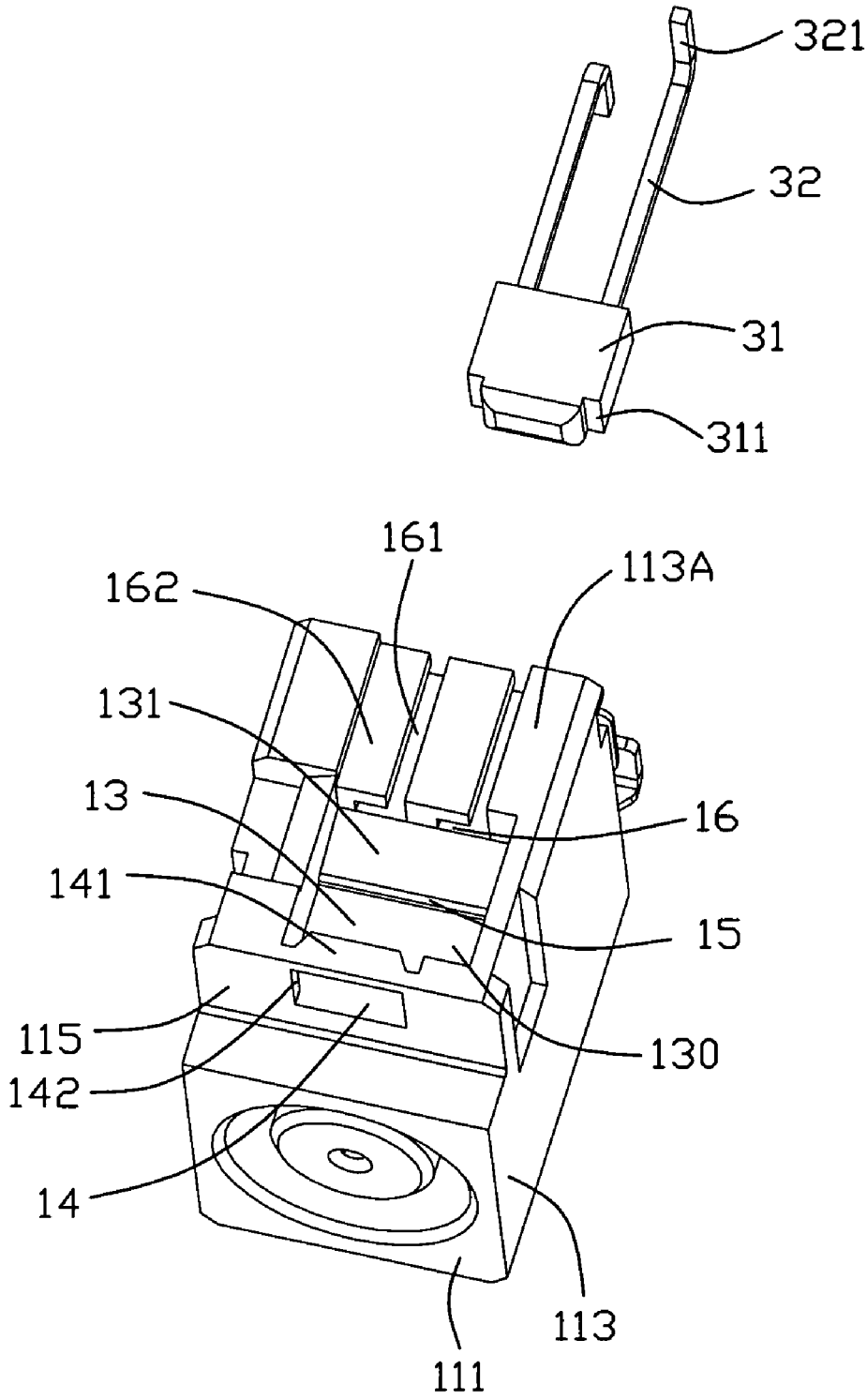
FIG. 3 is an exploded view of the electrical connector shown in FIG. 1 without a metallic shell thereon.
Figure 7:
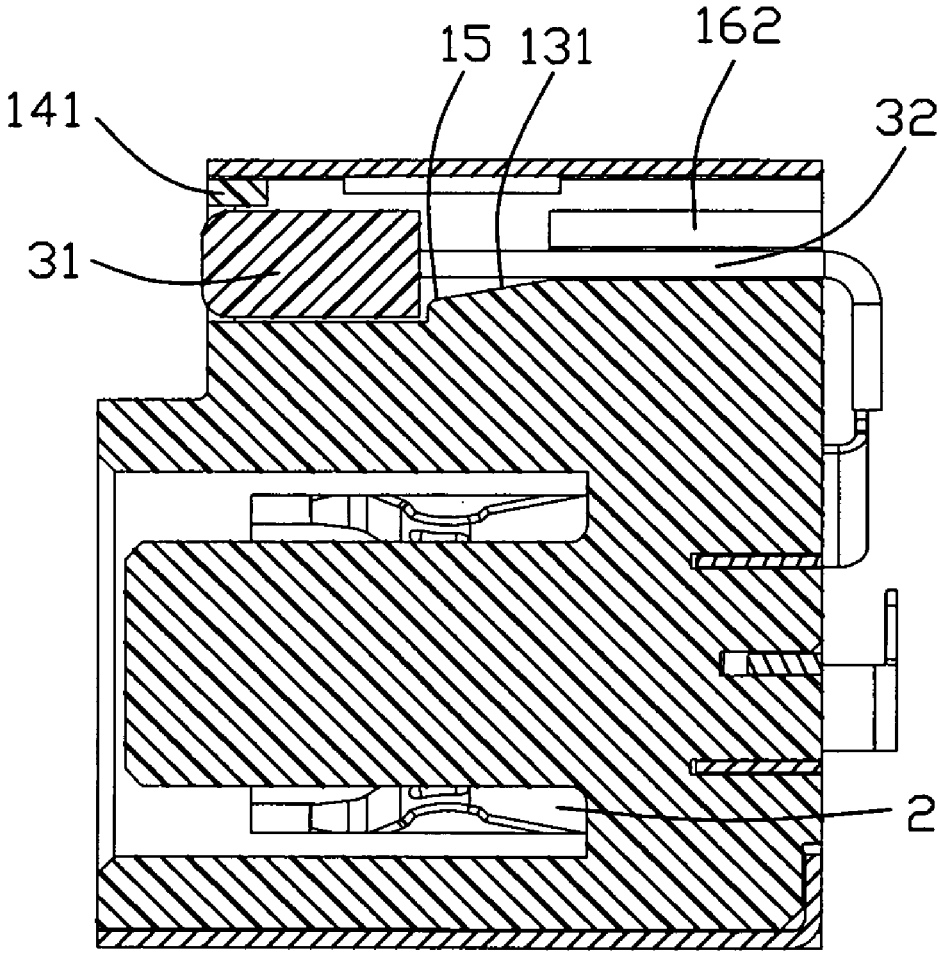
FIG. 7 is a cross-sectional view of the electrical connector shown in FIG. 1 along line 7-7.

Referring to FIGS. 2 and 3, the insulating housing 1 is in a rectangular shape and has a front wall 111, a rear wall 112 and four side walls 113 connecting with the front and rear walls. A receiving space 110 shown in FIG. 1 for receiving a mating plug (not shown) extends rearward from the front wall 111 of the insulating housing 1. A plurality of terminal grooves (not figured) are defined at an inside periphery of the receiving space 110 for retaining the terminals 2 therein as shown in FIG. 7. A front face of an upper portion of the insulating housing 1 is behind the front wall 111 for corresponding with the LED device 3.

A rectangular receiving cavity 13 recessed downward is defined in the side wall 113A, i.e. the top face of the housing. The receiving cavity 13 opens upwardly and runs through the front wall 111 in a rear-to-front direction by an opening 14. A dimension of the opening 14 in a transverse direction perpendicular to the rear-to-front direction is smaller than that of the receiving cavity 13, thereby a pair of first blocking portions 142 are formed at opposite transverse sides of the opening 14 and a retaining portion 141 is formed above the opening 14 and connecting with the first blocking portions 142. In other word, the retaining portion 141 and the first blocking portions 142 are integrally formed at a front portion of the receiving cavity 13.

The receiving cavity 13 has a bottom wall 130 in a step configuration, wherein a facing forward face 15 is located at a middle portion of the bottom wall and is defined as a second blocking portion. As a result, the receiving cavity 13 is divided into a first cavity and a second cavity. The second cavity is above the first cavity in a vertical direction and defines a guiding wall 131 inclining toward the first cavity 130 and connecting with the second blocking portion 15. A pair of passageways 16 in a parallel relationship are defined in the insulating housing 1 behind the receiving cavity 13. The passageways 16 and the receiving cavity 13 commonly define the receiving space for commonly receiving LED device 3. The passageways 16 run through the insulating housing in the rear-to-front direction and communicate with the receiving cavity 13. Each passageway 16 defines an elongated channel 161 opening outwardly and running through the side wall 113A, and the other portion of the side wall 113A above the passageway 16 is named as a stopping portion 162. The passageways 16 are corresponding with the opening 14 in the rear-to-front direction.

The LED device 3 comprises an illuminant portion 31 and a pair of soldering legs 32 extending rearward from the illuminant portion 31. A front end of the illuminant portion 31 becomes smaller in a transverse direction to form a pair of stopping faces 311 facing forward. The soldering legs 32 perpendicularly bend downward and upward at distal ends to form solder portions 321 thereof.

Figure 4:
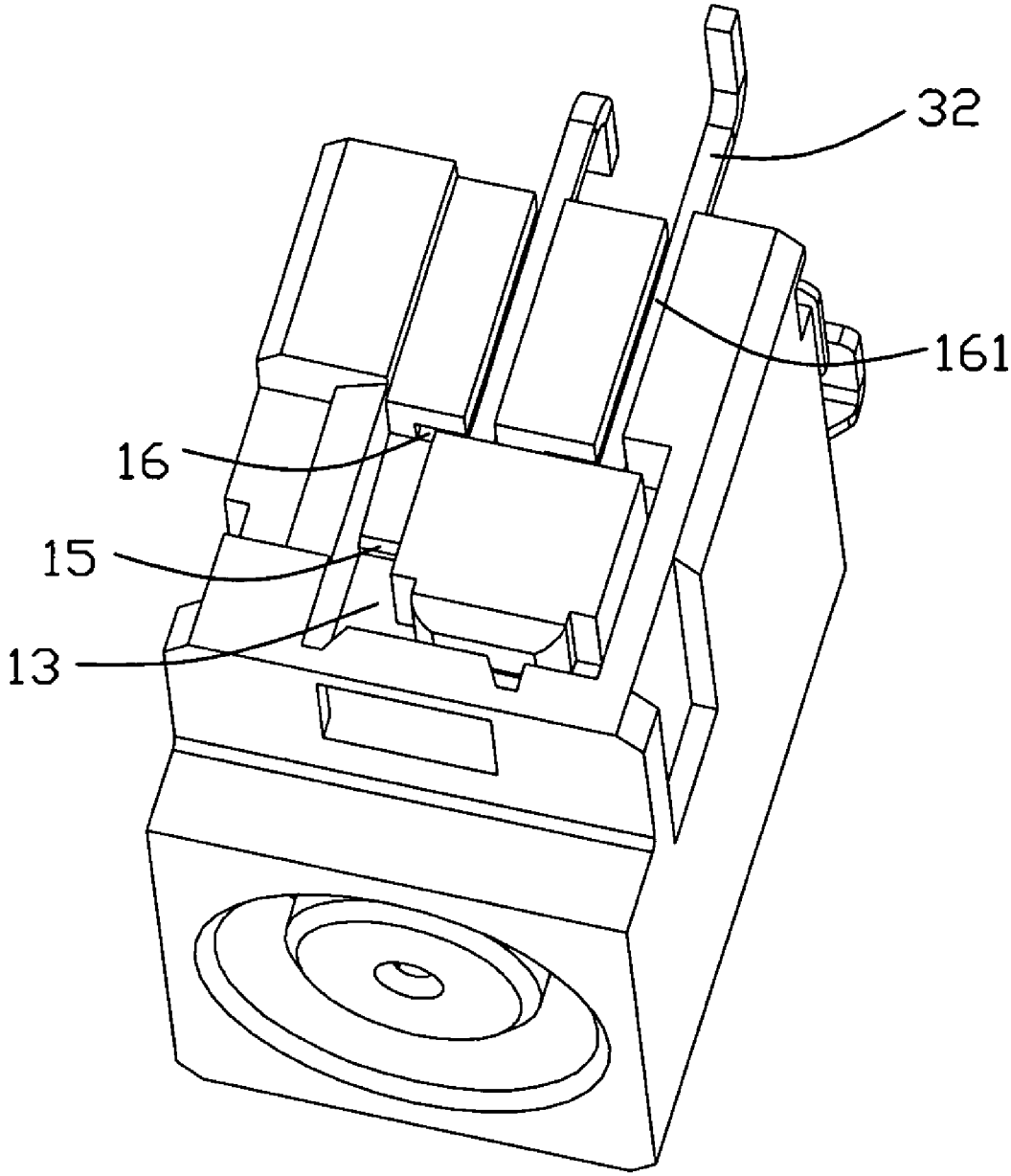
FIG. 4 to FIG. 6 show installing processes of a LED device to an insulating housing.
Figure 5:
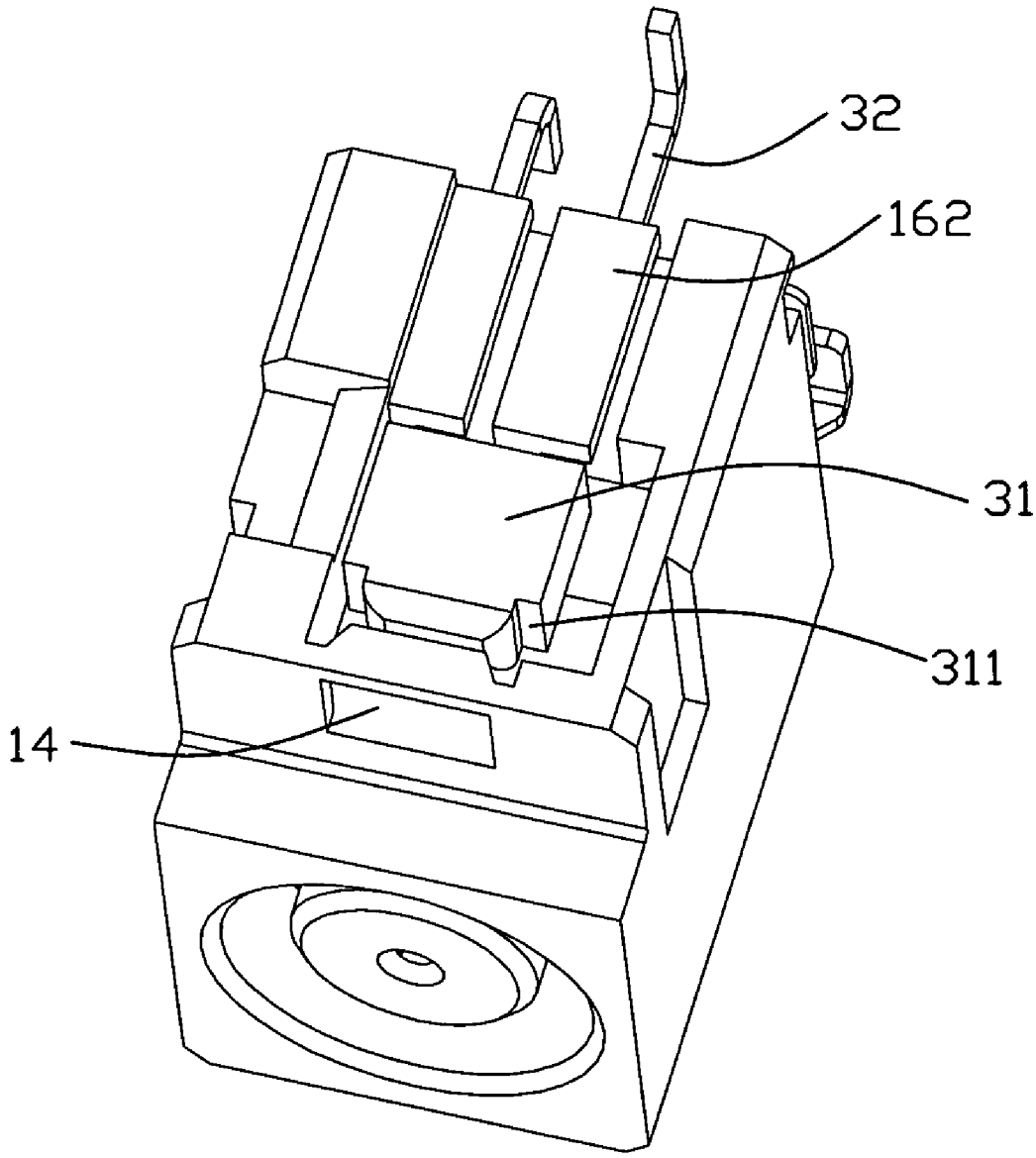
Figure 6:
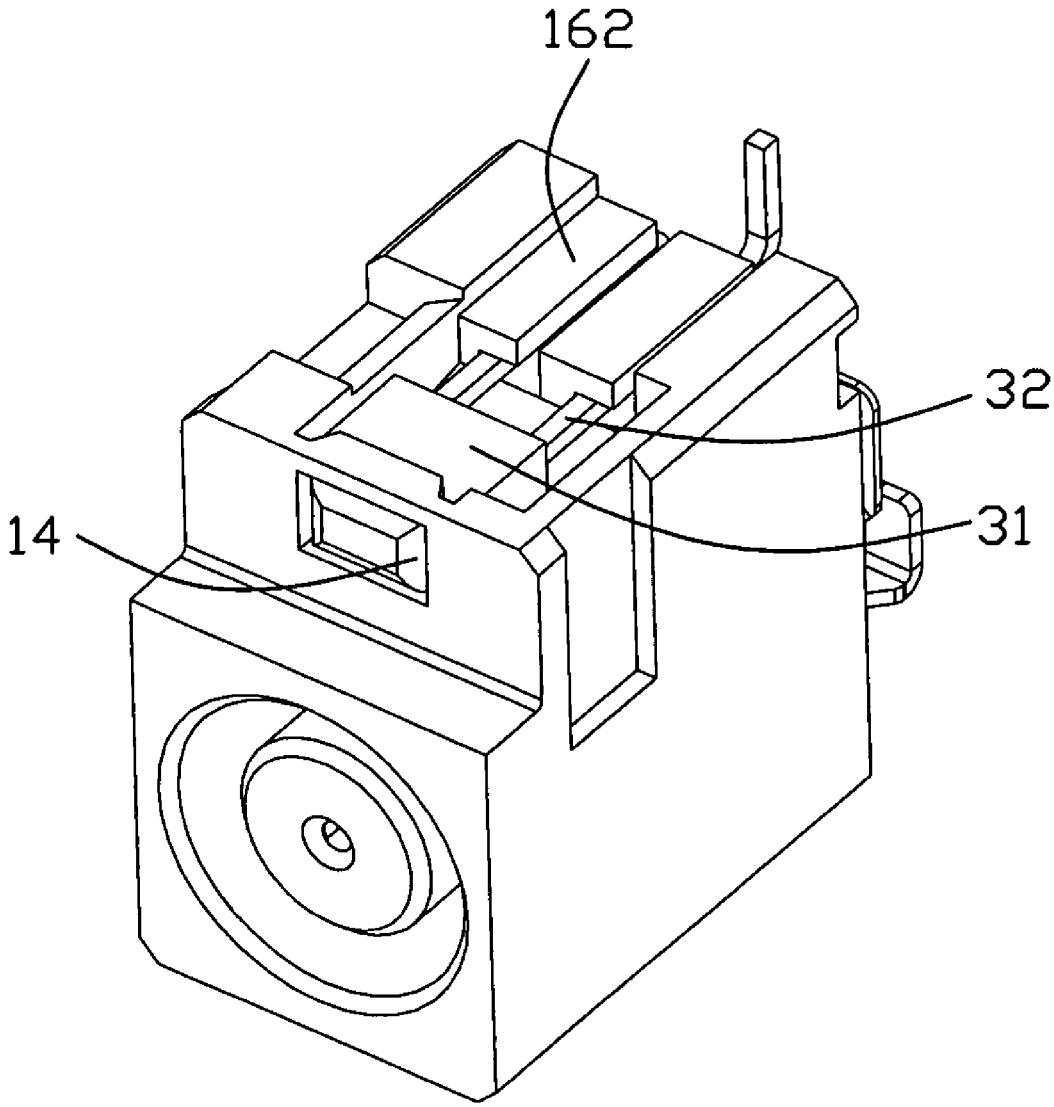

Referring to FIG. 4 to FIG. 6, when the LED device 3 is assembled to the housing 1, the illuminant portion 31 is firstly disposed in the rear cavity (above the second blocking portion 15), meanwhile, the soldering legs 32 surpass the elongated channels 161 to be located in the passageways 16. Then, the soldering legs 32 together with the illuminant portion 31 are moved in the transverse direction until the soldering legs 32 are located under the stopping portion 162 and the illuminant portion 31 is corresponding with the opening 14 in the rear-to-front direction. And then, the illuminant portion 31 is moved forwardly along the guiding wall 131 until the illuminant portion 31 is dropped into the first cavity. It is noted that the whole installing process is very simple and facility for mass production.

At this time, the illuminant portion 31 is inserted into the opening 14 partly, with a front portion located under the retaining portion 141 and sandwiched by the two first blocking portions 142, therefore, the illuminant portion 31 can not move in the vertical direction and transverse direction as the front portion is tightly engaging with the retaining portion 141 and first blocking portions 142. Two stopping faces 311 are located behind the opening 14 and abut against the first blocking portions 142, therefore, the illuminant portion 31 can not move forward in the rear-to-front direction. Moreover, a rear portion of the illuminant portion 31 abuts against the second blocking portion 15, so that the illuminant portion 31 can not move rearward in the rear-to-front direction. As the illuminant portion 31 is located in the first cavity, which is lower than the second cavity in the vertical direction, therefore, when the illuminant portion 31 is dropped into the first cavity, the soldering legs 32 will rise a little and fitly engage with the stopping portions 162. In a word, the retaining effect between the LED device 3 and the insulating housing 1 is pretty good.

The metallic shell 4 is assembled on the insulating housing 1 after the LED device 3 is retained in the receiving cavity 13. The metallic shell 4 is made by a metal sheet and bends into a rectangular shape to surround the insulating housing 1. A plurality of holding plates 41 extend from the metallic shell 4 and are received in apertures 1120 defined in the rear wall 112 of the insulating housing 1 to hold the shell 4 on the insulating housing 1.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

a display device comprising an illuminant portion and legs extending from the illuminant portion;

an insulating housing comprising a front wall, a rear wall, four side walls, and a receiving cavity recessed from one side wall and running though the front wall so as to form a retaining portion and at least one first blocking portion at a front section thereof; and a plurality of terminals mounted in the insulating housing thereof;

wherein the retaining portion is located at an outer side of the receiving cavity and being around and above the illuminant portion to prevent the illuminant portion from outward moving, and the first blocking portion is located in front of the illuminant portion and abuts against the illuminant portion to prevent the illuminant portion from forward moving;

an opening is defined in the front wall and surrounded by a pair of first blocking portions and the retaining portion, and the retaining portion is over the opening and connects with the first blocking portions;

the illuminant portion forms a pair of stopping faces at two sides thereof to abut against the first blocking portions, and a front section of the illuminant portion is received in the opening and enclosed by the first blocking portions and the retaining portion;

a second blocking portion is formed on a bottom wall of the receiving cavity and divides the receiving cavity into a first cavity near the front wall.

2. The electrical connector as described in claim 1, wherein a dimension of the opening in a transverse direction perpendicular to the rear-to-front direction is smaller than that of the receiving cavity.

3. The electrical connector as described in claim 2, wherein the receiving cavity opens upwardly and runs through the front wall in a rear-to-front direction by the opening.

4. The electrical connector as described in claim 1, wherein a second cavity higher than the first cavity in a vertical direction, the illuminant portion being received in the first cavity between the second blocking portion and front wall.

5. The electrical connector as described in claim 4, wherein a guiding wall is defined on the second cavity and inclines toward the first cavity and terminates at an upper edge of the second blocking portion.

6. The electrical connector as described in claim 4, wherein a pair of passageways run through a rear section of the housing and each passageway forms a stopping portion above, each stopping portion having an elongated channel to allow the legs of the LED device to pass.

7. The electrical connector as described in claim 6, wherein the elongated channels are located at the same side of each stopping portion, and the legs pass the channels in a vertical direction and then move to a bottom of the stopping portion in a transverse direction perpendicular to the vertical direction.

8. An electrical connector comprising:

a display device, comprising an illuminant portion and legs extending from the illuminant portion; and an insulating housing mounting a plurality of terminals therein, the insulating housing having a front wall, a rear wall, four side walls, and a receiving cavity defined in the insulating housing and running though one side wall, so as to form a retaining portion in a front section of the one side wall;

wherein the illuminant portion is located under the retaining portion and stopped by the front wall the retaining portion is forming around and above the illuminant portion to prevent the illuminant portion from outward moving, and the first blocking portion is located in front of the illuminant portion and abuts against the illuminant portion to prevent the illuminant portion from forward moving;

an opening is defined in the front wall and surrounded by a pair of first blocking portions and the retaining portion to abut against the illuminant portion, and the retaining portion is over the opening and connects with the first blocking portions;

the illuminant portion forms a pair of stopping faces at two sides thereof to abut against the first blocking portions, and a front section of the illuminant portion is received in the opening and enclosed by the first blocking portions and the retaining portion;

a second blocking portion is formed on a bottom wall of the receiving cavity and divides the receiving cavity into a first cavity near the front wall.

9. The electrical connector as described in claim 8, wherein a dimension of the opening in a transverse direction perpendicular to the rear-to-front direction is smaller than that of the receiving cavity.

10. The electrical connector as described in claim 9, wherein the retaining portion is located between the pair of first blocking portions and connecting with the first blocking portions.

11. The electrical connector as described in claim 9, wherein a second blocking portion is formed on a bottom wall of the receiving cavity and abuts against the illuminant portion for preventing the illuminant portion from rearward moving, a second cavity higher than the first cavity in a vertical direction, the illuminant portion being received in the first cavity between the second blocking portion and front wall.

12. An electrical connector comprising:

an insulative housing defining a first face and a second face adjacent to said first face, a receiving space communicating with an exterior on said first face in a first direction and on said second face in a second direction;

a display device defining an illuminant portion and a leg section extending from the illuminant portion;

the housing defining first and second retaining sections spaced from each other to respectively protectively restrain a portion of the illuminant portion and a portion of the leg section from movement in said second direction so as to retain the display device in position with regard to the housing under condition that said receiving cavity is configured to allow said display device to be assembled therein to from the exterior initially in a third direction opposite to the second direction, successively in a fourth direction perpendicular to both said first direction and said second direction to have the portion of the leg section restrained by the second retaining section in said second direction, and finally in said first direction to have the portion of the illuminant portion restrained by the first retaining section in said second direction;

wherein said housing is further unitarily equipped with a third retaining section to prevent the illuminant portion from moving in said first direction;

wherein said receiving space includes a receiving cavity for receiving and holding the illuminant portion therein, and a passageway communicating with the receiving cavity for receiving and holding the leg section therein;

wherein said passageway defines extends along the first direction with an L-shaped cross-section thereof;

wherein the leg section essentially extends in the first direction with a distal end section extending in the second direction.

13. The electrical connector as claimed in claim 12, wherein the leg section includes two legs extending in the first direction with distal end sections respectively extending in the second and third directions.

14. The electrical connector as claimed in claim 12, wherein a wedge structure is formed in said receiving cavity so as to allow the illuminant portion to move smoothly in the first direction during installation while forming an obstruction to prevent movement of the illuminant portion in a fifth direction opposite to the first direction.

* * * * *